US007252578B2

(12) United States Patent
Yen

(10) Patent No.: US 7,252,578 B2
(45) Date of Patent: Aug. 7, 2007

(54) APPARATUS FOR CYLINDRICALLY GRINDING WORKPIECES

(75) Inventor: Shih-Chieh Yen, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,513

(22) Filed: Aug. 15, 2006

(65) Prior Publication Data

US 2007/0128993 A1 Jun. 7, 2007

(30) Foreign Application Priority Data

Dec. 2, 2005 (CN) ..... 2005 1 0102005

(51) Int. Cl.
*B24B 7/00* (2006.01)
*B24B 41/06* (2006.01)

(52) U.S. Cl. ..... 451/178; 451/384; 451/690; 451/461

(58) Field of Classification Search ..... 451/178, 451/367, 384, 390, 391, 438, 439, 461, 555
See application file for complete search history.

(56) References Cited

U.S. PATENT DOCUMENTS 1,336,928 A * 4/1920 Simmons ..... 335/285
4,445,678 A * 5/1984 George ..... 269/88
4,583,432 A * 4/1986 Bricker ..... 82/1.11
5,305,557 A * 4/1994 Warncke ..... 451/369
6,554,265 B2 * 4/2003 Andronica ..... 269/268
7,144,306 B1 * 12/2006 Yen ..... 251/57

* cited by examiner

*Primary Examiner*—Dung Van Nguyen
(74) *Attorney, Agent, or Firm*—Jeffrey T. Knapp

(57) ABSTRACT

An apparatus for cylindrically grinding workpieces includes a first holding tool (10) and a second holding tool (12). The first holding tool is configured for positioning pre-grinding workpieces (18). The first holding tool defines a first groove (103) for containing the pre-grinding workpieces. A first stopping board (106) is detachably connected to one side of the first holding tool, and a first pressing mechanism (107) is elastically connected to another side. The first pressing mechanism and the first stopping board cooperatively press the pre-grinding workpieces into the first groove. The second holding tool (12) is configured for positioning the partially ground workpieces. The second holding tool defines a second groove (123) for containing the partially ground workpieces. A second stopping board (126) is connected to one side of the second holding tool, and a second pressing mechanism (127) is elastically connected to another side.

12 Claims, 7 Drawing Sheets

APPARATUS FOR CYLINDRICALLY GRINDING WORKPIECES

FIELD OF THE INVENTION

The present invention generally relates to cylindrical grinding apparatuses and, more particularly, to a holder for holding workpieces during a cylindrical grinding process.

DESCRIPTION OF RELATED ART

Usually, optical elements such as camera lenses and spectacles are in used in cylindrical form. However, original optical workpieces (i.e. lens blanks) are most easily manufactured in the form of a square. Therefore, these original optical workpieces have to be cylindrically ground before use.

A typical example of a contemporary cylindrical grinding apparatus is a central apparatus. The central apparatus typically includes a pair of holders for holding the original workpiece, where each holder has a hollow chamber communicating with a surface of the holder. The holder can hold the workpiece on its surface by using an air pump pumping the hollow chamber, a grinding wheel is then used to cylindrically grind the workpiece. However, the central apparatus can only cylindrically grind one workpiece at a time.

FIGS. 6-7 show an apparatus for cylindrically grinding more than one workpiece at a time. The apparatus includes a first holding tool 30 and a second holding tool 40. The first holding tool 30 defines a holding groove 32, and the second holding tool 40 defines a semicircular groove 42. The holding groove 32 and the semicircular groove 42 are both for securing the workpieces 50 in the holding tools 30, 40. In use, firstly, a plurality of workpieces 50 are placed in the holding groove 32 of the first holding tool 30. Secondly, the workpieces 50 are bonded together using adhesive. Thirdly, a grinding wheel is used to grind a portion of the workpieces 50 projecting out of the holding groove 32 into a semicircular shape. Fourthly, the semicircular portion 51 of the workpieces 50 is transferred to the semicircular groove 42 of the second holding tool 40. Fifthly, the other portion of the workpieces 50 is also ground into a semicircular shape using the grinding wheel. The final result being that the workpieces 50 are ground to a cylindrical shape.

When transferring the workpieces 50 from the first holding tool 30 to the second holding tool 40, the adhesive should be dissolved so that the workpieces 50 can be taken out of the first holding tool 30. However, it can take a long time to dissolve the adhesive during the grinding process.

Therefore, an apparatus for cylindrically grinding workpieces which can hold the workpieces without adhesive is desired.

SUMMARY OF THE INVENTION

In one embodiment, an apparatus for cylindrically grinding workpieces includes a first holding tool and a second holding tool. The first holding tool is configured for positioning pre-grinding workpieces. The first holding tool defines a first groove for containing the pre-grinding workpieces to be partially ground. A first stopping board is detachably connected one side of the first holding tool, and a first pressing mechanism is elastically connected to another side of the first holding tool. The first pressing mechanism and the first stopping board are configured for pressing the pre-grinding workpieces in the first groove. The second holding tool is configured for positioning the partially ground workpieces. The second holding tool defines a second groove for containing the partially ground workpieces. A second stopping board is connected to one side of the second holding tool, and a second pressing mechanism is elastically connected to another side of the second holding tool. The second pressing mechanism and the second stopping board are configured for pressing the partially ground workpieces in the second groove.

Other advantages and novel features will become more apparent from the following detailed description when taken in conjunction with the accompanying drawings.

BRIEF DESCRIPTION OF THE DRAWINGS

Many aspects of the apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
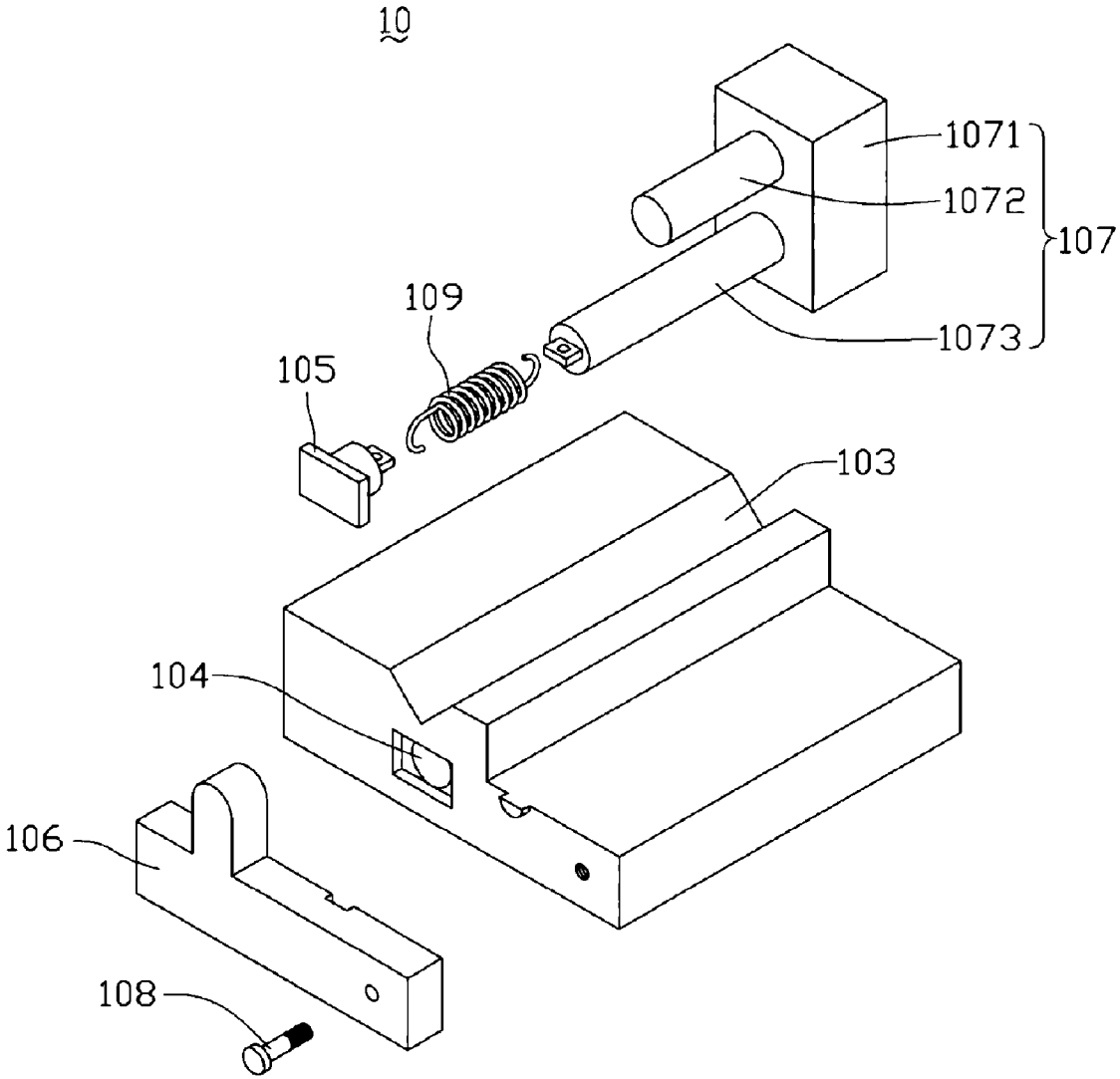
FIG. 1 is an exploded, schematic view of a first holding tool of an apparatus for cylindrically grinding workpieces in accordance with a preferred embodiment.
Figure 2:
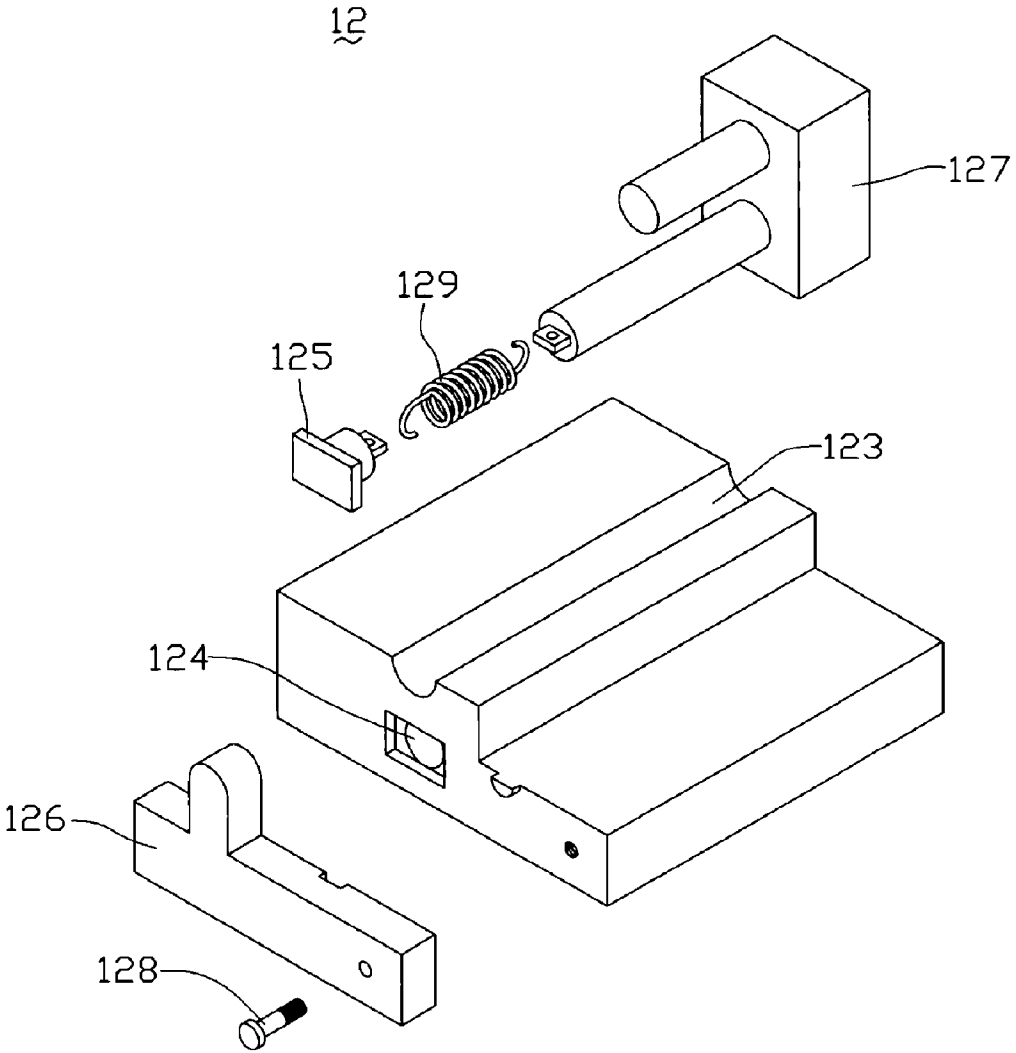
FIG. 2 is an exploded, schematic view of a second holding tool of the apparatus for cylindrically grinding workpieces in accordance with the preferred embodiment.

Referring to FIGS. 1-4, in a preferred embodiment, an apparatus for cylindrically grinding workpieces, includes a first holding tool 10, a second holding tool 12, and a grinding wheel 14. The holding tools 10, 12 are configured for positioning workpieces 18. In this embodiment, the workpieces 18 are optical elements, such as infrared cut filters and ultraviolet cut filters.

The first holding tool 10 defines a first groove 103 for containing pre-grinding workpieces 18. The pre-grinding workpieces 18 can be optical elements having a non-cylindrical shape. In this preferred embodiment, the workpieces 18 are in substantially square form. Therefore, the first groove 103 is configured to have a V-shaped cross section, for compliantly receiving the pre-grinding workpieces 18 therein. Understandably, the cross section of the first groove 103 can be of other shape depending on the form of the pre-grinding workpieces 18. The pre-grinding workpieces 18 are partially ground on the first groove 103 using the grinding wheel 14. A first through hole 104 is formed below the first groove 103, and the through hole 104 penetrates the first holding tool 10. A first stopping board 106 is detachably connected to one side of the first holding tool 10 by a bolt 108. A securing block 105 is also disposed at this side of the first holding tool 10, and the securing block 105 is connected to this side of the through hole 104. A first pressing mechanism 107 is elastically connected at another side of the first holding tool 10, the first pressing mechanism 107 and the first stopping board 106 are configured for pressing the pre-grinding workpieces 18 in the first groove 103 in order to prevent the pre-grinding workpieces 18 moving out of the first groove 103 during the grinding process.

The first pressing mechanism 107 includes a body 1071, a pressing portion 1072, and a connecting portion 1073. The pressing portion 1072 and the connecting portion 1073 are formed on a same side of the body 1071. The connecting portion 1073 is contained in the first through hole 104, and connects the securing block 105 using a first elastic element 109. In this embodiment, the first elastic element 109 is a spring. When the first pressing mechanism 107 is installed in the first holding tool 10, the first elastic element 109 is tensioned and the pressing portion 1072 presses against the pre-grinding workpieces 18.

The second holding tool 12 defines a second groove 123 for containing the partially ground workpieces 18. The second groove 123 is configured to have a semicircular cross section. The partially ground workpieces 18 are ground to be cylinder shape on the second groove 123. A second stopping board 126 detachably connects one side of the second holding tool 12 using a second bolt 128. The second holding tool 12 also includes a second through hole 124, a second securing block 125, a second pressing mechanism 127, and a second elastic element 129.

The grinding wheel 14 can be disposed above the first holding tool 10 or the second holding tool 12. The grinding wheel 14 has a semicircular groove 142 for grinding the workpieces 18. The semicircular groove 142 has a same shape with the second groove 123 of the second holding tool 12. The grinding wheel 14 is connected to a driving mechanism 141. In this embodiment, the driving mechanism 141 is a motor.

Figure 3:
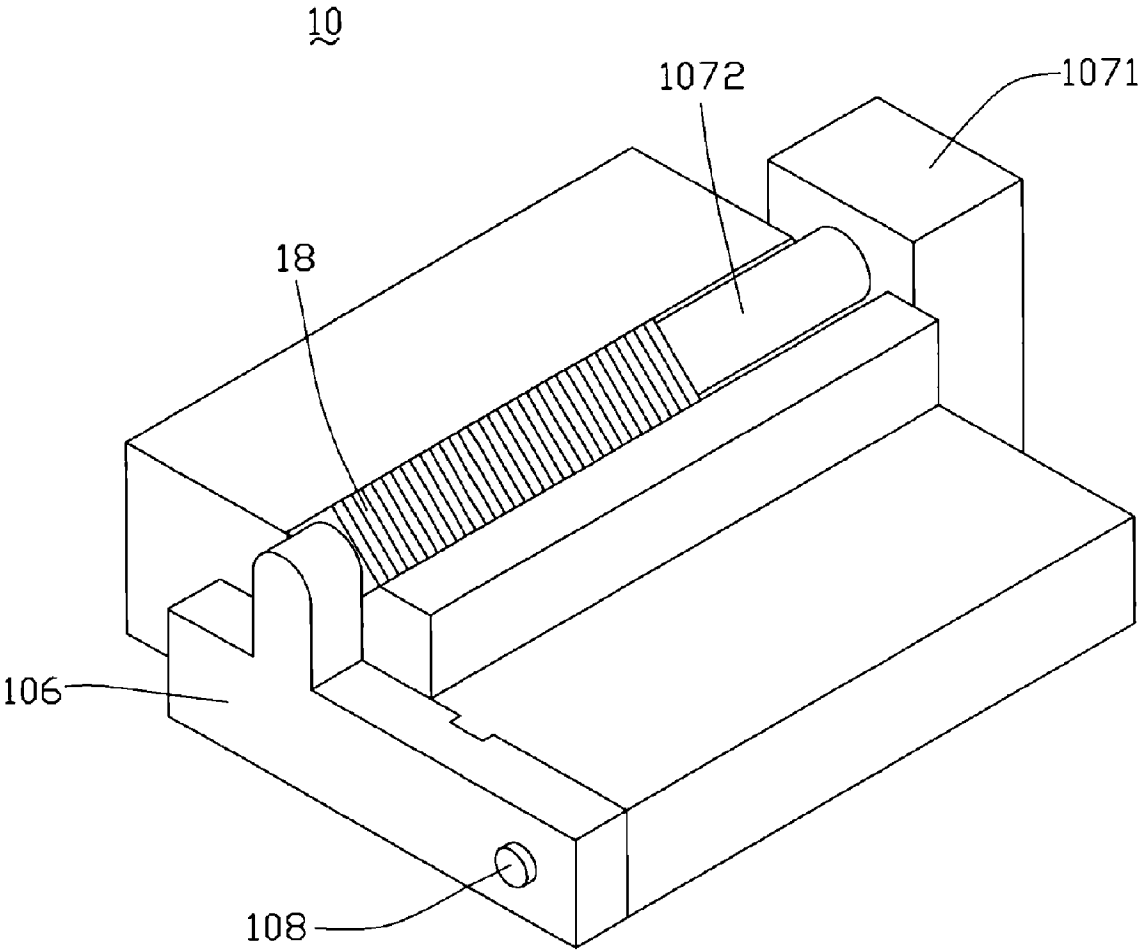
FIG. 3 is a schematic view of a step of the process for cylindrically grinding workpieces in accordance with a preferred embodiment.
Figure 4:
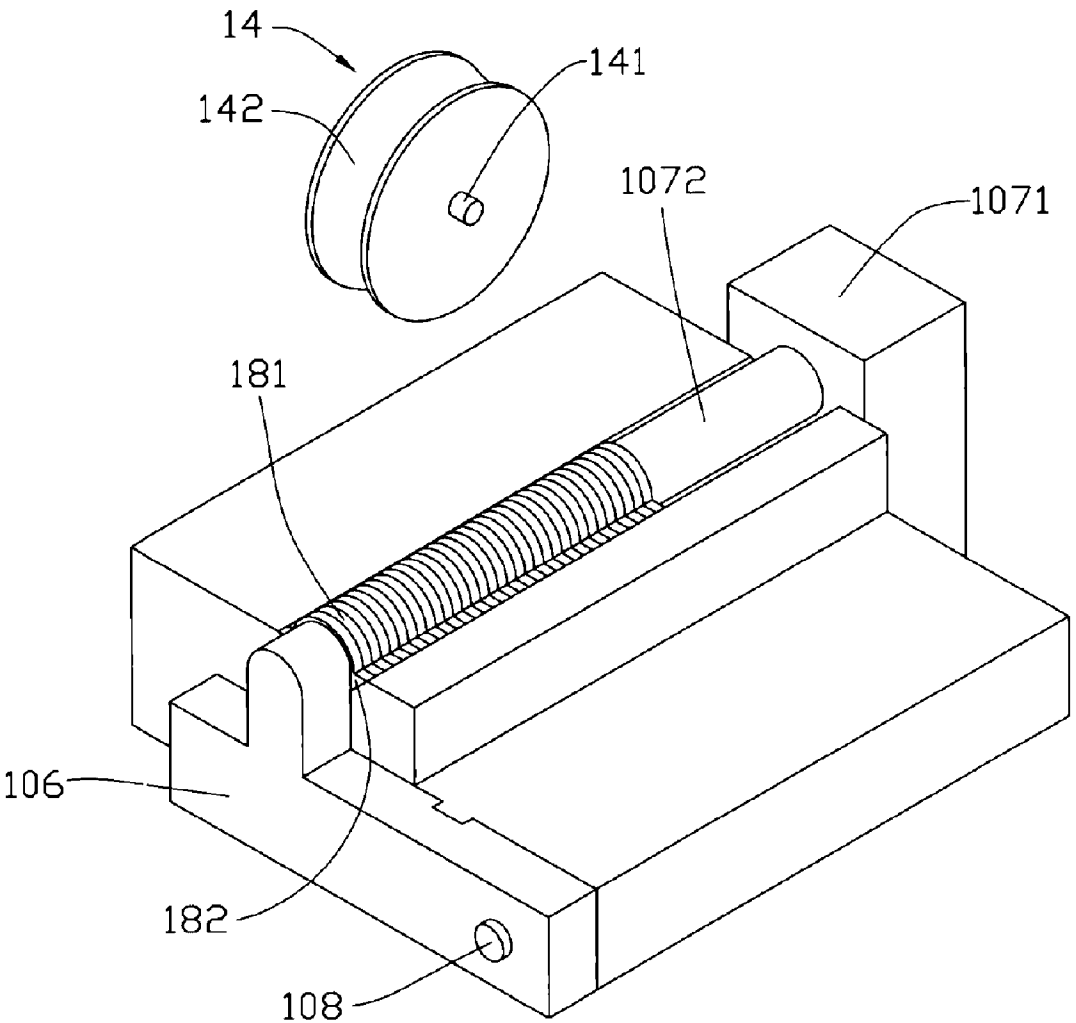
FIG. 4 is a schematic view of another step subsequent to the step in FIG. 3.
Figure 5:
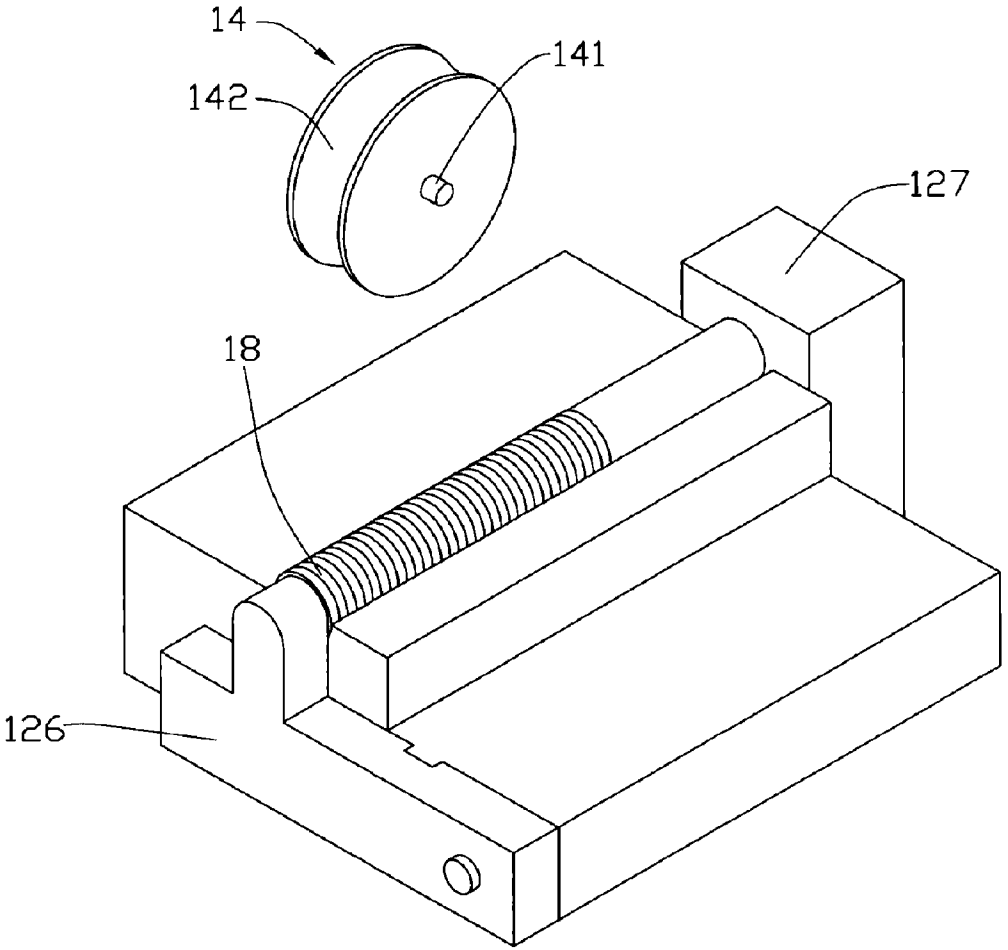
FIG. 5 is a schematic view of a further step subsequent to the step in FIG. 4.
Figure 6:
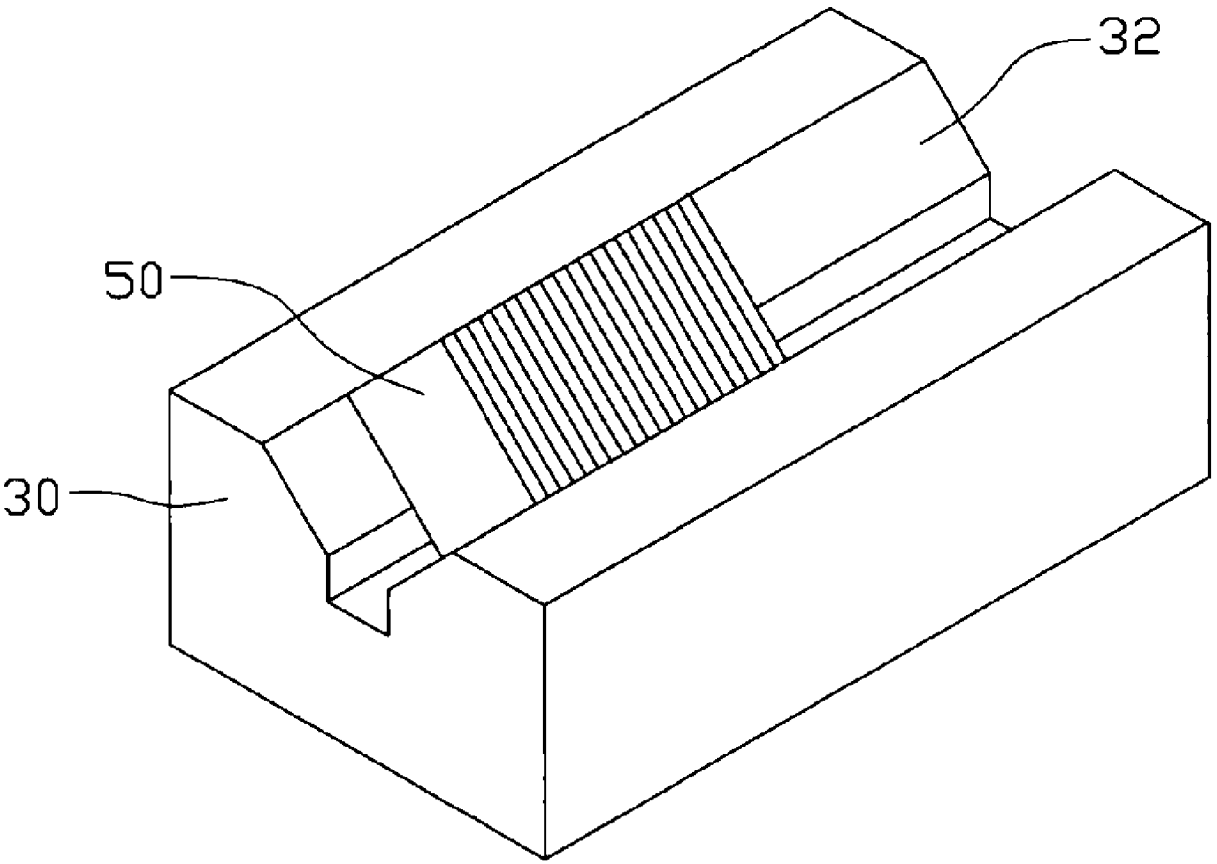
FIG. 6 (PRIOR ART)
FIG. 6 is a schematic view of a first holding tool for cylindrically grinding workpieces from the prior art.
Figure 7:
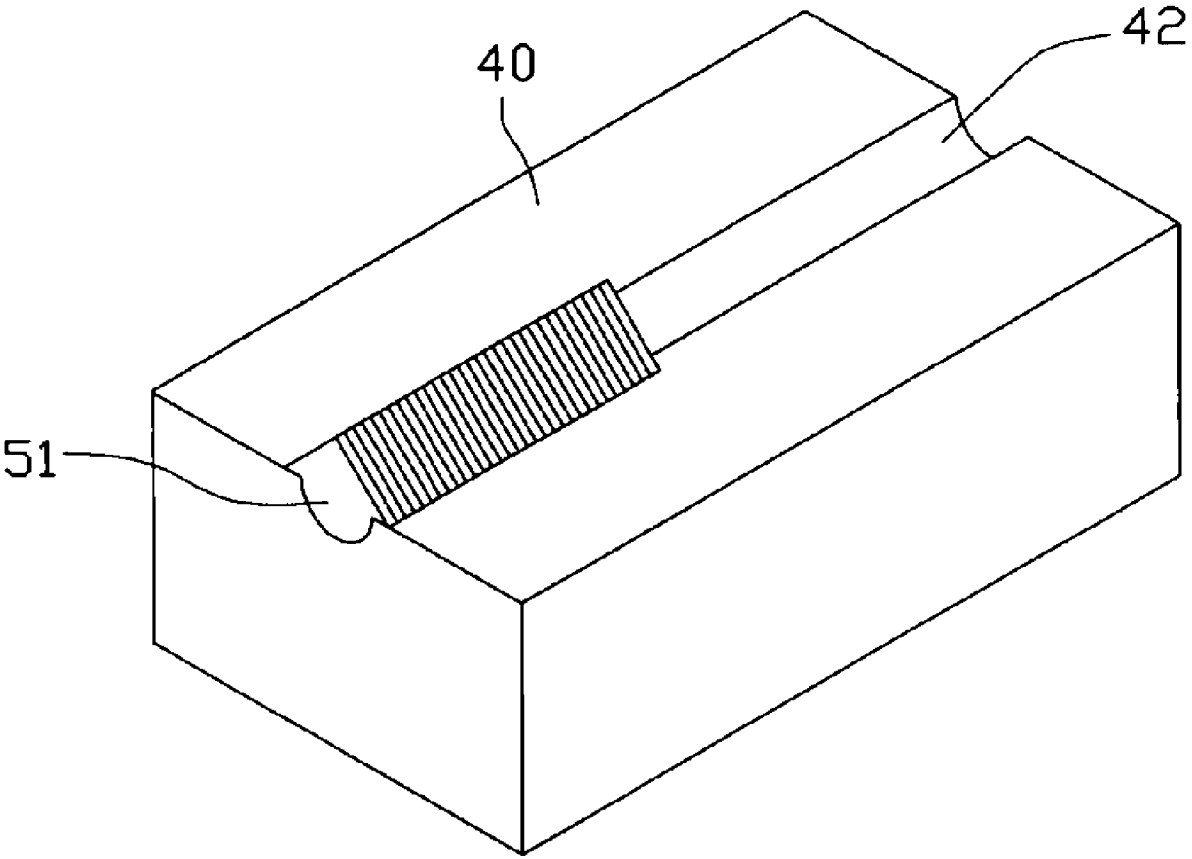
FIG. 7 (PRIOR ART)
FIG. 7 is a schematic view of a second holding tool for cylindrically grinding workpieces from the prior art.

Referring to FIGS. 3-5, an exemplary process for cylindrically grinding workpieces 18 includes the steps of:

(1) A stack of workpieces 18 (i.e. pre-grinding workpieces) are placed in the first groove 103 of the first holding tool 10. A first portion 181 of the pre-grinding workpieces 18 projects out of the first groove 103.

(2) The pre-grinding workpieces 18 are pressed together in the first groove 103 using the first stopping board 106 and the first pressing mechanism 107.

(3) The first portion 181 of the pre-grinding workpieces 18 is partially ground to a semicircular shape.

(4) The partially ground workpieces 18 are placed in the second holding tool 12 with the first portion 181 held in the second groove 123, and the partially ground workpieces 18 are pressed together in the second groove 123 using the second stopping board 126 and the second pressing mechanism 127. A second portion 182 of the workpieces 18 projects out of the second grooves 123.

(5) The second portion 182 of the workpieces 18 is ground to a semicircular shape. In this way a plurality of cylindrical workpieces 18 can be obtained.

In this process workpieces 18 are easily and compactly held in the first groove 103 or the second groove 123 using the stopping boards 106, 126 and the pressing mechanisms 107, 127, which can promote the working efficiency of the cylindrical process.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An apparatus for cylindrically grinding workpieces, comprising:

a first holding tool for positioning pre-grinding workpieces, the first holding tool defining a first groove for containing the pre-grinding workpieces to be partially ground, a first stopping board being detachably connected to one side of the first holding tool, a first pressing mechanism being elastically connected to another side of the first holding tool, the first pressing mechanism and the first stopping board being configured for pressing the pre-grinding workpieces in the first groove; and a second holding tool for positioning the partially ground workpieces, the second holding tool defining a second groove for containing the partially ground workpieces, a second stopping board connecting one side of the second holding tool, a second pressing mechanism being elastically connected to another side of the second holding tool, the second pressing mechanism and the second stopping board being configured for pressing the partially ground workpieces into the second groove.

2. The apparatus as claimed in claim 1, wherein the first pressing mechanism and the second pressing mechanism each comprise a body, a pressing portion, and a connecting portion.

3. The apparatus as claimed in claim 2, wherein the pressing portion and the connecting portion are formed on a same side of the body.

4. The apparatus as claimed in claim 2, wherein each of the connecting portions is connected to the holding tools by means of an elastic element, and each of the elastic elements is tensioned when the pressing mechanisms are connected to the holding tools.

5. The apparatus as claimed in claim 4, wherein each of the first holding tool and the second holding tool has a through hole for containing the elastic element and the connecting portion of the pressing mechanism.

6. The apparatus as claimed in claim 4, wherein each of the elastic elements is a spring.

7. The apparatus as claimed in claim 1, wherein the first groove has a V-shaped cross section.

8. The apparatus as claimed in claim 1, wherein the stopping boards are detachably connected to the holding tools by means of bolts.

9. The apparatus as claimed in claim 1, further comprising a grinding wheel for grinding the workpieces.

10. The apparatus as claimed in claim 9, wherein the grinding wheel has a semicircular groove.

11. The apparatus as claimed in claim 10, wherein the semicircular groove has a same shape with that of the second groove of the second holding tool.

12. The apparatus as claimed in claim 1, wherein the workpieces are optical elements.

* * * * *